US011859142B2

(12) United States Patent
Ayar et al.

(10) Patent No.: US 11,859,142 B2
(45) Date of Patent: Jan. 2, 2024

(54) HYDROCRACKING PROCESS FOR MAXIMIZATION OF NAPHTHA

(71) Applicant: UOP LLC, Des Plaines, IL (US)

(72) Inventors: Yoga Ramamurthi Ayar, Buffalo Grove, IL (US); Rajesh Sivadasan, Nootdorp (NL); Richard Hoehn, Mount Prospect, IL (US); Donald A. Eizenga, Elk Grove Village, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 17/245,269

(22) Filed: Apr. 30, 2021

(65) Prior Publication Data

US 2022/0348832 A1 Nov. 3, 2022

(51) Int. Cl.

| | |
|---|---|
| ***C10G 65/10*** | (2006.01) |
| ***C10G 67/06*** | (2006.01) |
| ***C10G 65/12*** | (2006.01) |
| ***C10G 65/14*** | (2006.01) |

(52) U.S. Cl.

CPC ..... *C10G 67/06* (2013.01); *C10G 65/10* (2013.01); *C10G 65/12* (2013.01); *C10G 65/14* (2013.01); *C10G 2300/4081* (2013.01); *C10G 2400/04* (2013.01); *C10G 2400/06* (2013.01); *C10G 2400/10* (2013.01)

(58) Field of Classification Search

CPC ..... C10G 65/14; C10G 65/10; C10G 65/12; C10G 2300/4081; C10G 2400/06; C10G 2400/04; C10G 2400/10

See application file for complete search history.

(56) References Cited

U.S. PATENT DOCUMENTS

| | | | | |
|---|---|---|---|---|
| 3,365,390 A * | 1/1968 | Egan | ..... | C10G 67/04 208/60 |
| 3,733,260 A * | 5/1973 | Davies | ..... | C10G 49/22 208/212 |
| 5,985,132 A * | 11/1999 | Hoehn | ..... | C10G 65/00 208/58 |

(Continued)

OTHER PUBLICATIONS

"Search Report and Written Opinion for H217595-WO", dated Aug. 9, 2022.

*Primary Examiner* — Michelle Stein

(74) *Attorney, Agent, or Firm* — Paschall & Associates, LLC; James C. Paschall

(57) ABSTRACT

A hydrocracking process for maximization of naphtha while producing base oil is disclosed. The hydrocracking process comprises hydrocracking a hydrocarbon feed stream in a hydrocracking unit in the presence of a hydrogen stream and a hydrocracking catalyst to produce a hydrocracked effluent stream. The hydrocracked effluent stream is separated in a separator to provide a vapor hydrocracked stream and a liquid hydrocracked stream. The liquid hydrocracked stream is fractionated to provide a naphtha stream, a kerosene stream, a diesel stream and a first unconverted oil stream. A recycle stream comprising a portion of the kerosene stream, a portion of the diesel stream, and a portion of the first unconverted oil stream is recycled to the hydrocracking unit to provide a second unconverted oil stream. A remaining portion of the first unconverted oil stream is withdrawn for base oil production.

14 Claims, 1 Drawing Sheet

(56) References Cited

U.S. PATENT DOCUMENTS 6,093,672 A * 7/2000 Winquist ..... C10G 47/18 423/325
6,217,746 B1 * 4/2001 Thakkar ..... C10G 65/10 208/100
6,261,441 B1 * 7/2001 Gentry ..... C10G 65/12 208/27
2003/0047486 A1 * 3/2003 Cash ..... C10G 65/10 208/89
2003/0221990 A1 * 12/2003 Yoon ..... C10G 65/12 208/59
2004/0079677 A1 * 4/2004 Farshid ..... C10G 65/12 208/89
2004/0092385 A1 * 5/2004 Timken ..... B01J 29/126 502/64
2006/0131212 A1 * 6/2006 Dahlberg ..... C10G 65/12 208/59
2007/0084751 A1 * 4/2007 Wang ..... C10G 47/20 208/59
2007/0102321 A1 * 5/2007 Wang ..... B01J 29/80 502/67
2009/0050524 A1 * 2/2009 Kim ..... C10G 65/12 208/89
2013/0043161 A1 * 2/2013 Hoehn ..... C10G 49/22 208/100
2014/0262941 A1 * 9/2014 Ramaseshan ..... B01D 3/141 208/58
2014/0262942 A1 * 9/2014 Arora ..... C10L 1/06 422/187
2014/0262948 A1 * 9/2014 Van Wees ..... C10G 47/26 208/102
2016/0024396 A1 * 1/2016 Zink ..... C10G 67/02 208/209
2018/0171245 A1 * 6/2018 Smith ..... C10G 67/02
2018/0187116 A1 * 7/2018 Yeh ..... C10G 65/00
2019/0161692 A1 5/2019 Mani
2019/0330546 A1 10/2019 Plennevaux et al.

* cited by examiner

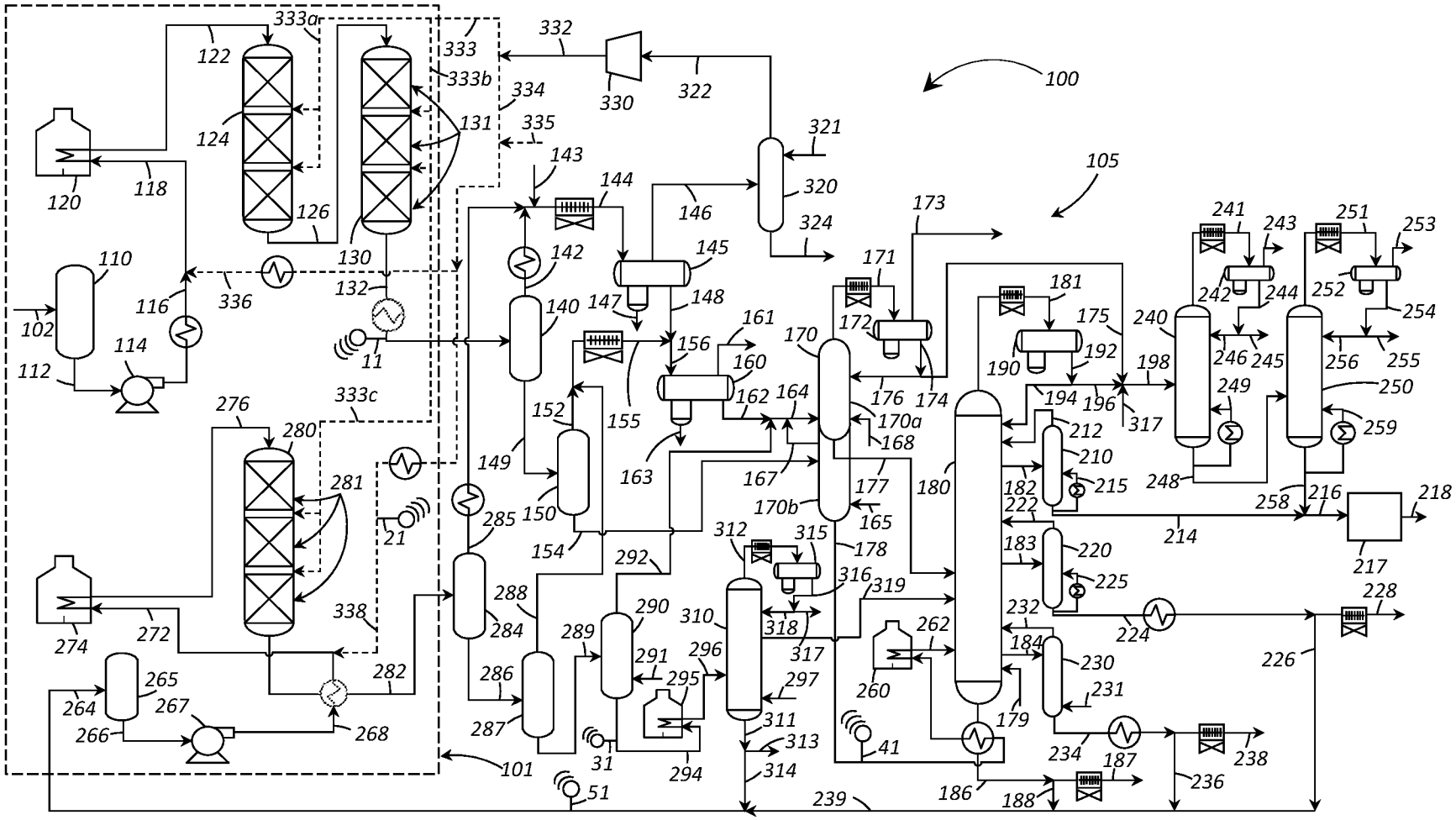

HYDROCRACKING PROCESS FOR MAXIMIZATION OF NAPHTHA

FIELD

The field relates to a hydrocracking process for maximization of naphtha. Particularly, the field relates to a hydrocracking process maximization of naphtha while producing base oil.

BACKGROUND

Hydroprocessing can include processes which convert hydrocarbons in the presence of hydroprocessing catalyst and hydrogen to more valuable products. Hydrocracking is a hydroprocessing process in which hydrocarbons crack in the presence of hydrogen and hydrocracking catalyst to lower molecular weight hydrocarbons. Depending on the desired output, a hydrocracking unit may contain one or more fixed beds of the same or different catalyst. Typically, hydrocracking process is employed to crack hydrocarbon feeds such as vacuum gas oil (VGO) to diesel including kerosene and gasoline motor fuels. Hydrocracking can be achieved in one or more stages. Usually, in a hydrocracking process, a hydrocracked effluent is fractionated which produces various fractions including an unconverted oil (UCO). The unconverted oil is recycled back to the reactors with hydrocracking catalyst without value addition or recovery.

Naphtha is primarily used as a petrochemical feedstock for aromatic complexes and naphtha crackers for producing more valuable petrochemical products. Current configuration of multistage hydrocracking units for production of high quality base oil from the UCO which is produced from a hydrocracking unit maximizes the production of kerosene and diesel. Flow schemes that maximize production of distillates, kerosene and diesel along with lubes from the UCO uses distillate selective catalysts perhaps in a multistage hydrocracking unit. In this flow scheme, production of naphtha is limited due to the use of distillate selective catalyst. If it is desired to maximize naphtha production, a naphtha selective catalyst will have to be used in the reactors instead of distillate selective catalysts. However, the naphtha selective catalyst will reduce the quality of UCO for the production of base oil. For petrochemical production, it is desired to achieve the twin objectives of producing high quality lubes while maximizing the naphtha production in the hydrocracking unit.

Accordingly, it is desirable to provide new hydrocracking apparatuses and processes for maximization of naphtha for producing more valuable petrochemical products while producing base oil with the desired quality. Other desirable features and characteristics of the present subject matter will become apparent from the subsequent detailed description of the subject matter and the appended claims, taken in conjunction with the accompanying drawings and this background of the subject matter.

BRIEF SUMMARY

Various embodiments contemplated herein relate to hydrocracking processes and apparatuses The exemplary embodiments taught herein provide a hydrocracking process for hydrocracking a hydrocarbon feed stream.

In accordance with an exemplary embodiment, a hydrocracking process for maximization of naphtha while producing base oil is provided. The hydrocracking process may comprise hydrocracking a hydrocarbon feed stream in a hydrocracking unit in the presence of a hydrogen stream and a hydrocracking catalyst to produce a hydrocracked effluent stream. The hydrocracked effluent stream may be separated in a separator to provide a vapor hydrocracked stream and a liquid hydrocracked stream. The liquid hydrocracked stream may be fractionated to provide a naphtha stream, a kerosene stream, a diesel stream and a first unconverted oil stream. A recycle stream comprising a portion of the kerosene stream, a portion of the diesel stream, and a portion of the first unconverted oil stream may be recycled to the hydrocracking unit to provide a second unconverted oil stream. A remaining portion of the first unconverted oil stream may be withdrawn for base oil production.

In with another exemplary embodiment, a hydrocracking process for maximization of naphtha while producing base oil is provided. The hydrocracking process may comprise hydrocracking a hydrocarbon feed stream in a first stage hydrocracking reactor in the presence of a first hydrogen stream and a distillate selective catalyst to produce a first hydrocracked effluent stream. The first hydrocracked effluent stream may be separated to provide a vapor hydrocracked stream and a liquid hydrocracked stream. The liquid hydrocracked stream may be fractionated to provide a naphtha stream, a kerosene stream, a diesel stream and a first unconverted oil stream. A portion of the kerosene stream, a portion of the diesel stream, and a portion of the first unconverted oil stream, may be recycled to a second stage hydrocracking reactor. A second unconverted oil stream and a recycle stream comprising the portion of the kerosene stream, the portion of the diesel stream may be hydrocracked in the second stage hydrocracking reactor in the presence of the naphtha selective catalyst and a second hydrogen stream to produce a second hydrocracked effluent stream. The second hydrocracked effluent stream may be separated to provide the second unconverted oil stream. A remaining portion of the first unconverted oil stream may be withdrawn for base oil production.

The present disclosure envisages a process meeting the twin objectives of producing high quality lubes while maximizing the naphtha production in the hydrocracking unit in an integrated manner.

These and other features, aspects, and advantages of the present disclosure will become better understood upon consideration of the following detailed description, drawings and appended claims.

BRIEF DESCRIPTION OF THE DRAWING

The various embodiments will hereinafter be described in conjunction with the following FIGURE, wherein like numerals denote like elements.

The FIGURE is a schematic diagram of a hydrocracking process and an apparatus for maximization of naphtha while producing base oil in accordance with an exemplary embodiment.

Definitions

As used herein, the term "column" means a distillation column or columns for separating one or more components of different volatilities. Unless otherwise indicated, each column includes a condenser on an overhead of the column to condense the overhead vapor and reflux a portion of an overhead stream back to the top of the column. Also included is a reboiler at a bottom of the column to vaporize and send a portion of a bottom stream back to the bottom of the column to supply fractionation energy. Feeds to the columns may be preheated. The top pressure is the pressure of the overhead vapor at the outlet of the column. The bottoms temperature is the liquid bottom outlet temperature. Overhead lines and bottom lines refer to the net lines from the column downstream of the reflux or reboil to the column. Alternatively, a stripping stream may be used for heat input at the bottom of the column.

As used herein, the term "passing" includes "feeding" and "charging" and means that the material passes from a conduit or vessel to an object.

As used herein, the term "portion" means an amount or part taken or separated from a main stream without any change in the composition as compared to the main stream. Further, it also includes splitting the taken or separated portion into multiple portions where each portion retains the same composition as compared to the main stream.

As used herein, the term "unit" can refer to an area including one or more equipment items and/or one or more sub-units. Equipment items can include one or more reactors or reactor vessels, heaters, separators, drums, exchangers, pipes, pumps, compressors, and controllers. Additionally, an equipment item, such as a reactor, dryer, or vessel, can further include one or more units or sub-units.

The term "communication" means that material flow is operatively permitted between enumerated components.

The term "downstream communication" means that at least a portion of material flowing to the subject in downstream communication may operatively flow from the object with which it communicates.

The term "C," wherein "x" is an integer means a hydrocarbon stream with hydrocarbons have x carbon atoms.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator. The separator may be operated at higher pressure than the flash drum.

A stream can include various hydrocarbon molecules such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 Cn where "n" represents the number of carbon atoms in the one or more hydrocarbon molecules. Furthermore, a "+" or "−" may be used with an abbreviated one or more hydrocarbons notation, e.g., C3− or C3+, which may be inclusive of the abbreviated one or more hydrocarbons. As an example, the abbreviation "C3+" means one or more hydrocarbon molecules of three carbon atoms and/or more. Also, a stream can include one or more fluids other than or in addition to hydrocarbons. Such as air, nitrogen, and water.

As used herein, the term "bottoms stream" or "bottoms" can mean a stream withdrawn in a line extending from or near a bottom of a vessel, such as a column.

As used herein, the term "T5", "T10", "T90", or "T95" means the temperature at which 5 volume percent or 10 volume percent or 90 volume percent or 95 volume percent, as the case may be, respectively, of the sample boils using ASTM D 86 or ASTM D 1160.

As used herein, the term "True Boiling Point" (TBP) means a test method for determining the boiling point of a material which corresponds to ASTM D2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "initial boiling point" (IBP) means the temperature at which the sample begins to boil using ASTM D 86.

As used herein, the term "diesel cut" or "diesel stream" means hydrocarbons boiling in the range of an IBP between about 125° C. (257° F.) and about 175° C. (347° F.) or a T5 between about 204° C. (399° F.) and about 238° C. (460° F.) or a T90 between about 360° C. (680° F.) and 383° C. (721° F.) using the TBP distillation method.

DETAILED DESCRIPTION

Applicants disclose a process and an apparatus meeting the twin objective of producing high quality lubes while maximizing the naphtha production in the hydrocracking unit. Applicants' hydrocracking process maximizes naphtha production along with co-production of distillates and high quality UCO for base oil production through an integrated flow scheme shown in the FIGURE. Applicants' hydrocracking process uses both distillate selective catalysts and naphtha selective catalysts in the same hydrocracking unit shown in the FIGURE. Applicants' hydrocracking process not only maximizes naphtha production but also produces high quality UCO which can be used for base oil production along with distillates. Maximization of naphtha along with production of high quality base oil and distillates from the integrated hydrocracking unit with the same product qualities instead of using two separate units also reduces the CAPEX. The current hydrocracking process includes hydrocracking unit with two reactor stages upstream of a fractionation section involving two separate but integrated product strippers, and two separate but integrated product fractionation columns. The integrated hydrocracking unit is tailored to produce high quality UCO from the first stage as a base oil feedstock while making blended distillate products and high naphtha production from both reaction stages.

The process and apparatus have been demonstrated in a pilot plant and is a viable option for a two stage hydrocracking unit to maximize naphtha production while producing high quality UCO for base oil production meeting the desired specifications.

The following detailed description is merely exemplary in nature and is not intended to limit the various embodiments or the application and uses thereof. Furthermore, there is no intention to be bound by any theory presented in the preceding background or the following detailed description. The FIGURES have been simplified by the deletion of a large number of apparatuses customarily employed in a process of this nature, such as vessel internals, temperature and pressure controls systems, flow control valves, recycle pumps, etc. which are not specifically required to illustrate the performance of the process. Furthermore, the illustration of the current process in the embodiment of a specific drawing is not intended to limit the process to specific embodiments set out herein.

As depicted, process flow lines in the FIGURES can be referred to, interchangeably, as, e.g., lines, pipes, branches, distributors, streams, effluents, feeds, products, portions, catalysts, withdrawals, recycles, suctions, and discharges.

A hydrocracking process for maximization of naphtha while producing base oil is addressed with reference to a process and an apparatus 100 according to an embodiment as shown in the FIGURE. Referring to the FIGURE, the process and apparatus 100 comprise a hydrocracking unit 101 and a fractionation section 105. A hydrocarbon feed stream in line 102 and a hydrogen stream in line 336 are fed to the hydrocracking unit 101. The hydrocarbon feed stream in line 102 is the fresh feed to the hydrocracking unit 101. In an exemplary embodiment, the hydrocracking unit 101 may be a two stage hydrocracking unit 101 comprising a first stage hydrocracking reactor 130 and a second stage hydrocracking reactor 280. The hydrocracking unit 101 may also comprise a hydrotreating reactor 124.

In one aspect, the hydrocarbon feed stream in line 102 fed to the hydrocracking unit 101 may comprise a hydrocarbon stream having an initial boiling points (IBP) above about 288° C. (550° F.), such as atmospheric gas oils, vacuum gas oil (VGO) having T5 and T95 between about 315° C. (600° F.) and about 600° C. (1100° F.), deasphalted oil, coker distillates, straight run distillates, pyrolysis-derived oils, high boiling synthetic oils, cycle oils, hydrocracked feeds, catalytic cracker distillates, atmospheric residue having an IBP at or above about 343° C. (650° F.) and vacuum residue having an IBP above about 510° C. (950° F.).

The hydrocarbon feed stream in line 102 may enter the hydrocracking unit 101 via a feed surge drum 110. From the bottoms of the feed surge drum 110, the feed flows in line 112 to the suction of a feed charge pump 114 to provide a pumped hydrocarbon feed stream in line 116. The hydrogen stream in line 336 may be added to the pumped hydrocarbon feed stream in line 116 to provide a mixed feed stream in line 118. The hydrogen stream in line 336 may be taken from a compressed hydrogen stream in line 332 as described hereinafter in detail. In an exemplary embodiment, the hydrogen stream in line 336 is a first hydrogen stream. In an aspect, the hydrogen stream in line 336 may join the pumped hydrocarbon feed stream in line 116 as the first hydrogen stream to provide the mixed feed stream in line 118. The mixed feed stream in line 118 may be heated in a first stage feed heater 120. A heated hydrocarbon feed stream in line 122 may be fed to the hydrotreating reactor 124.

Hydrotreating is a process wherein hydrocarbons are contacted with hydrogen in the presence of hydrotreating catalysts which are primarily active for the removal of heteroatoms, such as sulfur, nitrogen, oxygen and metals from the hydrocarbon feedstock. In hydrotreating, hydrocarbons with double and triple bonds such as olefins may be saturated. Aromatics may also be saturated. Some hydrotreating processes are specifically designed to saturate aromatics.

In an exemplary embodiment, the hydrotreating reactor 124 may comprise a guard bed of hydrotreating catalyst followed by one or more beds of higher activity hydrotreating catalyst. The guard bed filters particulates and reacts with contaminants in the hydrocarbon feed stream such as metals like nickel, vanadium, silicon and arsenic which are detrimental to the higher activity hydrotreating catalyst. The guard bed may comprise material similar to the hydrotreating catalyst.

Suitable hydrotreating catalysts for use in the present process may include any known conventional hydrotreating catalysts. The hydrotreating catalysts may comprise at least one Group VIII metal including iron, cobalt and nickel, or cobalt and/or nickel and at least one Group VI metal including molybdenum and tungsten, on a high surface area support material such as alumina. Other suitable hydrotreating catalysts may include zeolitic catalysts, as well as noble metal catalysts where the noble metal is selected from palladium and platinum. More than one type of hydrotreating catalyst may be used in the same hydrotreating reactor 124. In an exemplary embodiment, the Group VIII metal may be present in an amount ranging from about 2 wt % to about 20 wt %, or from about 4 wt % to about 12 wt %. In another exemplary embodiment, the Group VI metal may be present in an amount ranging from about 1 wt % to about 25 wt %, or from about 2 wt % to about 25 wt %.

The reaction conditions in the hydrotreating reactor 124 may include a temperature from about 290° C. (550° F.) to about 455° C. (850° F.), or from about 316° C. (600° F.) to about 427° C. (800° F.), a pressure from about 2.1 MPa (gauge) (300 psig), or from 4.1 MPa (gauge) (600 psig) to about 20.6 MPa (gauge) (3000 psig), or to about 12.4 MPa (gauge) (1800 psig), a liquid hourly space velocity of the hydrocarbon feed stream from about 0.1 $hr^{-1}$, or from about 4 $hr^{-1}$, to about 8 $hr^{-1}$, or from about 1.5 $hr^{-1}$ to about 3.5 $hr^{-1}$, and a hydrogen rate of about 168 Nm3/m3 (1,000 scf/bbl), to about 1,011 Nm3/m3 oil (6,000 scf/bbl), or from about 168 Nm3/m3 oil (1,000 scf/bbl) to about 674 Nm3/m3 oil (4,000 scf/bbl), with a hydrotreating catalyst or a combination of hydrotreating catalysts. Optionally, a first hydrogen manifold 333*a* may provide a first supplemental hydrogen stream in between the hydrotreating catalyst beds. The hydrotreating reactor 124 provides a hydrotreated hydrocarbon feed stream that exits the hydrotreating reactor 124 in line 126. The hydrogen gas laden with ammonia and hydrogen sulfide may be removed from the hydrotreated hydrocarbon feed stream in a separator, but the hydrotreated hydrocarbon feed stream in line 126 is typically fed directly to the first stage hydrocracking reactor 130 without separation. The hydrotreated hydrocarbon feed stream in line 126 may be passed to the first stage hydrocracking reactor 130 of the hydrocracking unit 101. The hydrotreated hydrocarbon feed stream in line 126 is hydrocracked in the presence of the first hydrogen stream and a first hydrocracking catalyst to produce a hydrocracked effluent stream.

The first stage hydrocracking reactor 130 may be a fixed bed reactor that comprises single or multiple catalyst beds, and various combinations of hydrotreating catalyst, and/or hydrocracking catalyst. The first stage hydrocracking reactor 130 may be operated in a continuous liquid phase in which the volume of the liquid hydrocarbon feed stream is greater than the volume of the hydrogen gas. The first stage hydrocracking reactor 130 may also be operated in a conventional continuous gas phase, a moving bed or a fluidized bed hydroprocessing reactor.

The first stage hydrocracking reactor 130 may comprise a plurality of the first hydrocracking catalyst beds 131. If the hydrocracking unit 101 does not include the hydrotreating reactor 124, the first bed 131 in the first stage hydrocracking reactor 130 may include hydrotreating catalyst for the purpose of saturating, demetallizing, desulfurizing, deoxygenating or denitrogenating the hydrocarbon feed before it is hydrocracked with first hydrocracking catalyst in subsequent catalyst beds in the first stage hydrocracking reactor 130. Otherwise, the first or an upstream bed in the first stage hydrocracking reactor 130 may comprise a hydrocracking catalyst bed.

In an aspect, the first hydrocracking catalyst in beds 131 of the first stage hydrocracking reactor 130 may comprise a distillate selective catalyst to produce a first hydrocracked effluent stream. In an exemplary embodiment, when the preferred products are middle distillates, the first hydrocracking catalysts may utilize amorphous silica-alumina bases or low-level zeolite bases combined with one or more Group VIII or Group VIB metal hydrogenating components. In another exemplary embodiment, when the preferred products are in the gasoline boiling range, the first hydrocracking catalysts may comprise, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms. It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8 and 12 Angstroms ($10^{-10}$ meters), wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 wt %, and preferably at least about 20 wt %, metal-cation-deficient, based on the initial ion-exchange capacity. In another aspect, a desirable and stable class of zeolites is one wherein at least about 20 wt % of the ion exchange capacity is satisfied by hydrogen ions.

In an embodiment, the active metals employed in the first hydrocracking catalysts of the present process as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. In an aspect, any amount between about 0.05 wt % and about 35 wt % may be used. In the case of the noble metals such as platinum and palladium, the amount of such metals may range from about 0.05 wt % to about 2 wt % noble metal. One such method for incorporating the hydrogenation metal is to contact the base materials with an aqueous solution of a suitable compound of the desired metals. Following addition of the selected hydrogenation metal or metals, the resulting catalyst powder is then filtered, dried, pelleted with added lubricants, binders or the like if desired, and calcined in air at temperatures of, e.g., about 371° C. (700° F.) to about 648° C. (1200° F.) in order to activate the catalyst and decompose ammonium ions. Alternatively, the base component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina co-gels, activated clays and the like in proportions ranging from about 5 to about 90 wt %. These diluents may be employed as such or they may contain a minor proportion of an added hydrogenating metal such as a Group VIB and/or Group VIII metal. Additional metal promoted hydrocracking catalysts may also be utilized in the present process which comprises, for example, aluminophosphate molecular sieves, crystalline chromosilicates and other crystalline silicates.

In an embodiment, the hydrocracking conditions of the first stage hydrocracking reactor 130 may include a temperature from about 290° C. (550° F.) to about 468° C. (875° F.), or from about 343° C. (650° F.) to about 445° C. (833° F.). In another embodiment, the first stage hydrocracking reactor 130 may operate at a first hydrocracking pressure from about 4.8 MPa (gauge) (700 psig) to about 20.7 MPa (gauge) (3000 psig), a liquid hourly space velocity (LHSV) from about 0.4 $hr^{-1}$ to less than about 5 $hr^{-1}$ and a hydrogen rate of about 421 $Nm^3/m^3$ (2,500 scf/bbl) to about 2,527 $Nm^3/m^3$ oil (15,000 scf/bbl).

The hydrocarbon feed stream in the hydrotreated hydrocarbon feed stream in line 126 is hydrocracked in the first stage hydrocracking reactor 130 operating at the first hydrocracking pressure in the presence of the first hydrogen stream passed in line 336 and the first hydrocracking catalyst to produce a first hydrocracked stream in line 132. The hydrotreated hydrocarbon feed stream in line 126 may be first passed to the top catalyst bed of the first hydrocracking catalyst. Subsequent catalyst beds in the first stage hydrocracking reactor 130 may comprise hydrocracking catalyst over which additional hydrocracking occurs to the first hydrocracked stream. Optionally, a second hydrogen manifold **333*b* may deliver a second supplemental hydrogen streams to one, some or each of the catalyst beds at the interbed locations in the first stage hydrocracking reactor 130. In an aspect, the supplemental hydrogen is added to each of the catalyst beds at an interstage location between adjacent beds, so supplemental hydrogen is mixed with hydroprocessed effluent exiting from the upstream catalyst bed before entering the downstream catalyst bed in the first stage hydrocracking reactor 130. The first hydrocracked effluent stream in line 132 is withdrawn from the bottoms of the first stage hydrocracking reactor 130. The first hydrocracked effluent stream in line 132 may be passed to the fractionation section 105 for separation. The fractionation section 105 may comprise one or more separators and fractionation columns in downstream communication with the hydrocracking unit 101. The first hydrocracked effluent stream in line 132 may be separated in a hot separator of the fractionation section 105 to provide a vapor hydrocracked stream and a liquid hydrocracked stream. In an exemplary embodiment, the first hydrocracked effluent stream in line 132 is passed to a first stage hot separator 140 of the fractionation section 105. In the first stage hot separator 140, the first hydrocracked effluent stream in line 132 may be separated to provide a first hot separated vapor hydrocracked stream in line 142 and a first hot separated liquid hydrocracked stream in line 149. The first hot separated vapor hydrocracked stream in line 142 is withdrawn from the overhead of the hot separator 140. The first hot separated liquid hydrocracked stream in line 149 is withdrawn from the bottoms of the hot separator 140**.

The first stage hot separator 140 may be in downstream communication with the hydrocracking unit 101. The first stage hot separator 140 may operate at a bottoms temperature from about 177° C. (350° F.) to about 371° C. (700° F.) or from about 232° C. (450° F.) to about 315° C. (600° F.). In an aspect, the bottoms temperature of the first stage hot separator 140 may be reduced to minimize any UCO in the overhead. The first stage hot separator 140 may be operated at a slightly lower pressure than the first stage hydrocracking reactor 130 accounting for pressure drop through intervening equipment. The first stage hot separator 140 may be operated at an overhead pressure from about 3.4 MPa (gauge) (493 psig) and about 20.4 MPa (gauge) (2959 psig). The first hot separated vapor hydrocracked stream in line 142 from the overhead of the first stage hot separator 140 may have a temperature of the operating temperature of the first stage hot separator 140.

The first hot separated vapor hydrocracked stream in line 142 may be cooled before entering a cold separator 145. As a consequence of the reactions taking place in the first stage hydrocracking reactor 130 wherein nitrogen, chlorine and sulfur are removed from the feed, ammonia and hydrogen sulfide are formed. At a characteristic sublimation temperature, ammonia and hydrogen sulfide will combine to form ammonium bisulfide and ammonia, and chlorine will combine to form ammonium chloride. Each compound has a characteristic sublimation temperature that may allow the compound to coat equipment, particularly heat exchange equipment, impairing its performance. To prevent such deposition of ammonium bisulfide or ammonium chloride salts in the first hot separated vapor hydrocracked stream in line 142, a suitable amount of wash water in line 143 may be introduced into the first hot separated vapor hydrocracked stream in line 142 upstream of a cooler at a point in the first hot separated vapor hydrocracked stream in line 142 where the temperature is above the characteristic sublimation temperature of either compound. As described hereinafter in detail, a second hot separated vapor hydrocracked stream in line 285 may be combined with the first hot separated vapor hydrocracked stream in line 142 to provide a combined hot separated vapor hydrocracked stream in line 144. The combined hot separated vapor hydrocracked stream in line 144 may be passed to the cold separator 145 to provide a cold separated vapor hydrocracked stream in line 146 and a cold separated liquid hydrocracked stream in line 148. The cold separated vapor hydrocracked stream in line 146 is withdrawn from the overhead of the cold separator 145. The cold separated liquid hydrocracked stream in line 148 is withdrawn from the bottoms of the cold separator 145.

The cold separated vapor hydrocracked stream in line 146 is a hydrogen-rich gas stream which can be recovered to be used as a hydrogen gas stream in the process. The cold separator 145 serves to separate hydrogen rich gas from the first hot separated vapor hydrocracked stream in line 142 and the second hot separated vapor hydrocracked stream in line 285 for recycle to the hydrocracking unit 101 in the cold separated vapor hydrocracked stream in line 146. The cold separator 145, therefore, is in downstream communication with the first hot separated vapor hydrocracked stream in line 142 of the first stage hot separator 140 and the hydrocracking unit 101. The cold separator 145 may be operated at a bottoms temperature from about 38° C. (100° F.) to about 66° C. (150° F.), or from about 46° C. (115° F.) to about 63° C. (145° F.), and below the pressure of the first stage hydrocracking reactor 130 and the first stage hot separator 150 accounting for pressure drop through intervening equipment to keep hydrogen and light gases in the overhead and normally liquid hydrocarbons in the bottoms. The cold separator 145 may be operated at an overhead pressure between about 3 MPa (gauge) (435 psig) and about 20 MPa (gauge) (2,901 psig). The cold separator 145 may also have a boot for collecting an aqueous phase in line 147. The cold separated liquid hydrocracked stream in line 148 may have a temperature of the operating temperature of the cold separator 160. The cold separated liquid hydrocracked stream in line 148 may be fractionated.

The cold separated vapor hydrocracked stream in line 146 is rich in hydrogen. Thus, hydrogen can be recovered from the cold separated vapor hydrocracked stream in line 146. The cold separated vapor hydrocracked stream in line 146 may be passed through a trayed or packed recycle scrubbing column 320 where it is scrubbed by means of a scrubbing extraction liquid such as an aqueous solution fed by line 321 to remove acid gases including hydrogen sulfide and carbon dioxide by extracting them into the aqueous solution. In an exemplary embodiment, the aqueous solution in line 321 may include lean amines such as alkanolamines DEA, MEA, and MDEA. Other amines can also be used in place of or in addition to these amines. The lean amine fed by line 321 contacts the cold separated vapor hydrocracked stream in line 146 and absorbs acid gas contaminants such as hydrogen sulfide and carbon dioxide. The resultant "sweetened" cold gaseous stream is taken out from an overhead outlet of the recycle scrubber column 320 in a recycle scrubber overhead line 322, and a rich amine is taken out from the bottoms at a bottom outlet of the recycle scrubber column 320 in a recycle scrubber bottoms line 324. The spent scrubbing liquid from the bottoms in line 324 may be regenerated and recycled back to the recycle scrubbing column 320 in line 321. The scrubbed hydrogen-rich stream emerges from the scrubber via the recycle scrubber overhead line 322. The scrubbed hydrogen-rich stream in the recycle scrubber overhead line 322 may be compressed in a recycle compressor 330 to provide the compressed hydrogen stream in line 332. The recycle scrubbing column 320 may be operated with a gas inlet temperature from about 38° C. (100° F.) and about 66° C. (150° F.) and an overhead pressure of about 3 MPa (gauge) (435 psig) to about 20 MPa (gauge) (2900 psig). Optionally, a supplemental hydrogen stream 333 may be separated from the compressed hydrogen stream in line 332. The supplemental hydrogen stream 333 may be separated into the first supplemental hydrogen stream in line 333*a*, the second supplemental hydrogen stream in line 333*b*, and a third supplemental hydrogen stream in line 333*c* which are passed to the hydrocracking unit 101. The scrubbed hydrogen-rich stream in the recycle scrubber overhead line 322 may be provided with a make-up hydrogen stream in the make-up line 335 upstream or downstream of the compressor 330. In exemplary embodiment, the make-up hydrogen stream in the make-up line 335 is combined with the scrubbed hydrogen-rich stream downstream of the compressor 330. In another exemplary embodiment, the make-up hydrogen stream in the make-up line 335 is combined with a compressed hydrogen stream in line 334 after the separation of supplemental hydrogen stream 333.

In an aspect, the first hot separated liquid hydrocracked stream in line 149 may be let down in pressure and flashed in a first stage hot flash drum 150 to provide a first hot vapor hydrocracked stream in line 152 and a first hot liquid hydrocracked stream in line 154. The light ends are separated in the first hot vapor hydrocracked stream in line 152 which may be withdrawn from the overhead of the first stage hot flash drum 150. The first hot liquid hydrocracked stream in line 154 may be withdrawn from the bottoms of the first stage hot flash drum 150. Accordingly, the first hot liquid hydrocracked stream in line 154 may be provided from the first stage hot separator 140. The hot flash drum 150 may be in direct, downstream communication with the first hot separated liquid hydrocracked stream in line 149 and in downstream communication with the hydrocracking unit 101. The light gases such as hydrogen sulfide may be stripped from the first hot liquid hydrocracked stream in line 154 in a stripper to provide a liquid hydrocracked stream. In an embodiment, the first hot liquid hydrocracked stream in line 154 may be stripped in a first stage stripper 170 to provide a liquid hydrocracked stream. The first stage stripper 170 may be in downstream communication with the first stage hot flash drum 150 and line 154 carrying the first hot liquid hydrocracked stream.

The first hot flash drum 150 may be operated at the same bottoms temperature as the first stage hot separator 140 but at a lower overhead pressure of between about 1.4 MPa (gauge) (200 psig) and about 6.9 MPa (gauge) (1000 psig), suitably no more than about 3.8 MPa (gauge) (550 psig). The hot liquid hydrocracked stream in line 154 may be further fractionated in the fractionation section 105. The first hot liquid hydrocracked stream in line 154 may have a temperature of the operating temperature of the first stage hot flash drum 150.

In an aspect, the cold separated liquid hydrocracked stream in line 148 may be directly fractionated. In a further aspect, the cold separated liquid hydrocracked stream in line 148 may be let down in pressure and flashed in a cold flash drum 160 to separate the cold separated liquid hydrocracked stream in line 148. The cold flash drum 160 may be in direct downstream communication with the cold separated liquid hydrocracked stream in line 148 of the cold separator 145 and in downstream communication with the hydrocracking unit 101.

In a further aspect, the hot vapor hydrocracked stream in 152 may be fractionated in the fractionation section 105. In a further aspect, the hot vapor hydrocracked stream in 152 may be cooled and also separated in the cold flash drum 160. In an exemplary embodiment, the first hot vapor hydrocracked stream in 152 may be combined with a second hot vapor hydrocracked stream in line 288 to provide a combined hot vapor hydrocracked stream in line 155. The combined hot vapor hydrocracked stream in line 155 may be passed to the cold flash drum 160. The cold flash drum 160 may separate the cold separated liquid hydrocracked stream in line 148 and the combined hot vapor hydrocracked stream in line 155 to provide a cold vapor stream in line 161 and a cold liquid stream in line 162. The cold vapor stream in line 161 may be withdrawn from an overhead of the cold flash drum 160. The cold liquid stream in line 162 may be withdrawn from the bottoms of the cold flash drum 160. In an embodiment, the cold separated liquid hydrocracked stream in line 148 and the combined hot vapor hydrocracked stream in line 155 may be combined to provide a combined separated stream in line 156. The combined separated stream in line 156 may be separated in the cold flash drum 160 to provide the cold vapor stream in line 161 and the cold liquid stream in line 162. In an aspect, light gases such as hydrogen sulfide may be stripped from the cold liquid stream in line 162. In an embodiment, the cold liquid stream in line 162 may be stripped in the first stage stripper 170 to provide the liquid hydrocracked stream. The stripper 170 may be in downstream communication with the cold flash drum 160 and the cold liquid stream in line 162.

The cold flash drum 160 may be in downstream communication with the line 148 the line 152, the line 288 and the hydrocracking unit 101. The cold separated liquid hydrocracked stream in line 148 and the combined hot vapor hydrocracked stream in 155 may enter into the cold flash drum 160 either together or separately. The cold flash drum 160 may be operated at the same bottoms temperature as the cold separator 145 but typically at a lower overhead pressure of between about 1.4 MPa (gauge) (200 psig) and about 6.9 MPa (gauge) (1000 psig) or between about 3.0 MPa (gauge) (435 psig) and about 3.8 MPa (gauge) (550 psig). A flashed aqueous stream may be removed from a boot in the cold flash drum 160 in line 163. The cold liquid stream in line 162 may have the same temperature as the operating temperature of the cold flash drum 160.

The fractionation section 105 may further include the first stage stripper 170, a second stage stripper 290, a first stage fractionation column 180, and a second stage fractionation column 310. In an embodiment, the first stage stripper 170 may be a vessel that contains a top cold stripper **170*a* and a bottom hot stripper 170*b* with a wall that isolates each of the stripping columns from the other. In an exemplary embodiment, the cold liquid stream in line 162 may be stripped in the cold stripper 170*a* and the first hot liquid hydrocracked stream in line 154 may be stripped in the hot stripper 170*b* of the stripping column 170 to provide the liquid hydrocracked stream. As described herein after in detail, an overhead vapor hydrocracked stream in line 292 may also be passed along with the cold liquid stream in line 162 to the cold stripper 170*a* of the first stage stripper 170. In an exemplary embodiment, the overhead vapor hydrocracked stream in line 292 may be combined with the cold liquid stream in line 162 and passed to the cold stripper 170*a* in line 164**.

The first hot liquid hydrocracked stream in line 154 may be passed to the hot stripper **170*b* of the first stage stripper 170. The cold liquid stream in line 162 may be fed to the first stage stripper 170 at a location above an entry point of the first hot liquid hydrocracked stream in line 154 to the first stage stripper 170. The cold liquid stream in line 162, the overhead vapor hydrocracked stream in line 292, and the hot liquid hydrocracked stream in line 154 may be stripped of gases in the first stage stripper 170 with a stripping media which is an inert gas such as steam to provide a gaseous stream of naphtha, hydrogen, hydrogen sulfide, steam and other gases in a vapor hydrocracked stream in line 171. A stripping media such as medium pressure steam in line 165 may be provided to the hot stripper 170*b*. The steam in line 165 is optionally a medium pressure steam and a steam at any suitable pressure may be provided to the hot stripper 170*b*. The stripping media to the cold stripper 170*a* may be provided with the overhead vapor hydrocracked stream in line 292. Alternatively, a stripping media such as medium pressure steam in line 168 may also be injected into the cold stripper 170*a*. The steam in line 168 is optionally a medium pressure steam and steam at any suitable pressure may be injected into the cold stripper 170*a*. In an exemplary embodiment, the cold liquid stream in line 162 and the overhead vapor hydrocracked stream in line 292 may be stripped of gases in the cold stripper 170*a* to provide the vapor hydrocracked stream in line 171 and a first liquid hydrocracked stream in line 177. In another exemplary embodiment, the first hot liquid hydrocracked stream in line 154 may be stripped of gases/vapors in the hot stripper 170*b* to provide a second liquid hydrocracked stream in line 178. The stripped gases/vapors may be withdrawn in line 167 from the overhead of the hot stripper 170*b*. The stripped gases/vapors in line 167 may be passed to the cold stripper 170***a*. In an exemplary embodiment, the stripped gases/vapors in line 167 may be passed to the cold stripper 170*a* in line 164 along with the cold liquid stream in line 162 and the overhead vapor hydrocracked stream in line 292.

The vapor hydrocracked stream in line 171 may be withdrawn from the overhead of the first stage stripper 170. The vapor hydrocracked stream in line 171 may be condensed and separated in an overhead receiver 172. A sour off gas stream in line 173 may be withdrawn from the overhead receiver 172. Unstabilized liquid naphtha from the bottoms of the receiver 172 may be split in a reflux portion refluxed to the top of the cold stripper 170*a* in a reflux line 176 and a first stage overhead naphtha stream in line 175 which may be further recovered or processed as described later in detail. In an aspect, the first stage overhead naphtha stream in line 175 may be passed to a debutanizer column 240 to separate LPG from light naphtha.

The cold stripper 170*a* may be operated with a bottoms temperature between about 149° C. (300° F.) and about 288° C. (550° F.), or a bottoms temperature of no more than about 260° C. (500° F.), and an overhead pressure of about 0.35 MPa (gauge) (50 psig), or an overhead pressure of no less than about 0.70 MPa (gauge) (100 psig), to no more than about 2.0 MPa (gauge) (290 psig). The temperature in the overhead receiver 172 may range from about 38° C. (100° F.) to about 66° C. (150° F.) and the pressure may be same as in the overhead of the cold stripper 170*a*. The hot stripper 170*b* may be operated with a bottoms temperature between about 160° C. (320° F.) and about 360° C. (680° F.) and an overhead pressure of about 0.35 MPa (gauge) (50 psig), or an overhead pressure of about 0.70 MPa (gauge) (100 psig), to about 2.0 MPa (gauge) (292 psig). The first liquid hydrocracked stream in line 177 and the second liquid hydrocracked stream in line 178 may be withdrawn from the bottoms of the cold stripper 170*a* and the bottoms of the hot stripper 170*b* respectively. The first liquid hydrocracked stream in line 177 and the second liquid hydrocracked stream in line 178 may be fractionated in the first stage fractionation column 180. In an embodiment, the second liquid hydrocracked stream in line 178 may be heated in a fractionation column feed heater 260 to provide a heated second liquid hydrocracked stream in line 262. The heated second liquid hydrocracked stream in line 262 may be fractionated in the first stage fractionation column 180. The first stage fractionation column 180 may be in a downstream communication with the first stage stripper 170. Low pressure steam in line 179 may be injected into the first stage fractionation column 180. The steam in line 179 is optionally a low pressure steam and steam at any suitable pressure may be injected to the first stage fractionation column 180. As described later in detail, a combined side draw stream in line 319 may also be passed to the first stage fractionation column 180. In an exemplary embodiment, the combined side draw stream in line 319 may be passed to the first stage fractionation column 180 at a location above the second liquid hydrocracked stream in line 262 and below the first liquid hydrocracked stream in line 177. The first stage fractionation column 180 separates the first liquid hydrocracked stream in line 177, the combined side draw stream in line 319, and the heated second liquid hydrocracked stream in line 262 into different product streams. In an embodiment, the first liquid hydrocracked stream in line 177, the combined side draw stream in line 319, and the heated second liquid hydrocracked stream in line 262 may be fractionated in the first stage fractionation column 180 to provide a naphtha stream, a kerosene stream, a diesel stream and a first unconverted oil (UCO) stream.

In an exemplary embodiment, the first liquid hydrocracked stream in line 177, the combined side draw stream in line 319, and the heated second liquid hydrocracked stream in line 262 are fractionated in the first stage fractionation column 180 to provide the fractionation column overhead stream in line 181, a first side draw stream comprising naphtha stream in line 182, a second side draw stream comprising kerosene stream in line 183, and a third side draw stream comprising the diesel stream in line 184, and the first unconverted oil (UCO) stream in line 186. The fractionated overhead stream in line 181 may be further processed to provide a light naphtha stream. In accordance with the present process, the first stage fractionation column 180 is a fractionation column 180 with multiple side cut stripping columns. In an exemplary embodiment, the first stage fractionation column 180 may comprise a first side cut stripping column 210, a second side cut stripping column 220, and a third side cut stripping column 230. Alternatively, the first side cut stripping column 210, a second side cut stripping column 220, and a third side cut stripping column 230 may be housed in a single vessel and optionally separated from each other by walls.

The first stage fractionation column 180 also separates light naphtha range hydrocarbons from heavy naphtha range hydrocarbons. In accordance with the present process, the light naphtha range hydrocarbons may be separated in the fractionation column overhead stream in line 181 and the heavy naphtha range hydrocarbons may be separated in the first side draw stream in line 182. Heavy naphtha may be separated from the first side draw stream in the first side cut stripping column 210. In an exemplary embodiment, the first side cut stripping column 210 is a heavy naphtha stripping column. The first side draw stream comprising heavy naphtha in line 182 may be fed to the first side cut stripping column 210. The first side draw stream comprising heavy naphtha in line 182 may be stripped of gases in the first side cut stripping column 210 to provide a gaseous stream having a lower amount of heavy naphtha than the first side draw stream in line 182. The gaseous stream may be withdrawn from the overhead of the first side cut stripping column 210 and passed to the first stage fractionation column 180 for further recovery. A heavy naphtha stream in line 214 may be withdrawn from the bottoms of the first side cut stripping column 210. A boilup stream of the first side cut stripping column 210 in the reboil line 215 is returned to the first side cut stripping column 210 after reboiling. The second side draw stream comprising kerosene in line 183 may be fed to the second side cut stripping column 220. In an exemplary embodiment, the second side cut stripping column 220 is a kerosene stripping column 220. In the second side cut stripping column 220, the second side draw stream in line 183 may be stripped of gases to separate a kerosene stream. A gaseous stream comprising a lower amount of kerosene than the second side draw stream in line 183 may be withdrawn in line 222 from the overhead of the second side cut stripping column 220 and passed to the first stage fractionation column 180 for further recovery. The kerosene stream may be withdrawn in line 224 from the bottoms of the second side cut stripping column 220. Also, a boilup stream of the second side cut stripping column 220 in the reboil line 225 is returned to the second side cut stripping column 220 after reboiling. In an embodiment, a kerosene yield ranging from about 10 wt % to about 40 wt % of the fresh feed in line 102 may be obtained in the kerosene stream in line 224 in accordance with the current process. In an aspect of the present disclosure, a portion of the kerosene stream in line 226 may be withdrawn and recycled to the hydrocracking unit 101. In an exemplary embodiment, the portion of the kerosene stream in line 226 recycled to the hydrocracking unit 101 may range from about 0 wt % to about 100 wt % of the kerosene stream in line 224. In another exemplary embodiment, the portion of the kerosene stream in line 226 recycled to the hydrocracking unit 101 may range from about 40 wt % to about 80 wt % of the kerosene stream in line 224. In yet another exemplary embodiment, the portion of the kerosene stream in line 226 recycled to the hydrocracking unit 101 may range from about 65 wt % to about 85 wt % of the kerosene stream in line 224. A kerosene product stream may be withdrawn in line 228. In another aspect, the kerosene stream in line 228 is a first stage kerosene product stream. In an exemplary embodiment, the first stage kerosene product stream in line 228 may range from about 100 wt % to about 0 wt % of the kerosene stream in line 224. In another exemplary embodiment, the first stage kerosene product stream in line 228 may range from about 60 wt % to about 20 wt % of the kerosene stream in line 224. In yet another exemplary embodiment, the first stage kerosene product stream in line 228 may range from about 35 wt % to about 15 wt % of the kerosene stream in line 224.

The third side draw stream comprising the diesel stream in line 184 may be passed to the third side cut stripping column 230. In an exemplary embodiment, the third side cut stripping column 230 is a diesel stripping column 220. A low pressure steam in line 231 may also be provided to the third side cut stripping column 230. The steam in line 231 is optionally a low pressure steam and steam at any suitable pressure may be provided to the third side cut stripping column 230. The third side draw stream in line 184 may be stripped of gases in the third side cut stripping column 230 to separate a diesel stream. A gaseous stream comprising a lower amount of diesel than the third side draw stream in line 184 may be withdrawn in line 232 from the overhead of the third side cut stripping column 230 and passed to the first stage fractionation column 180 for further recovery. The diesel stream may be withdrawn in line 234 from the bottoms of the third side cut stripping column 230. In an embodiment, a diesel yield ranging from about 10 wt % to about 50 wt % of the fresh feed in line 102 may be obtained in the diesel stream in line 234 in accordance with the current process. In an aspect of the present disclosure, a portion of the diesel stream in line 236 may be withdrawn and recycled to the hydrocracking unit 101. In an exemplary embodiment, the portion of the diesel stream in line 236 recycled to the hydrocracking unit 101 may range from about 0 wt % to about 100 wt % of the diesel stream in line 234. In another exemplary embodiment, the portion of the diesel stream in line 236 recycled to the hydrocracking unit 101 may range from about 55 wt % to about 95 wt % of the diesel stream in line 234. In yet another exemplary embodiment, the portion of the diesel stream in line 236 recycled to the hydrocracking unit 101 may range from about 65 wt % to about 85 wt % of the diesel stream in line 234. A diesel product stream may be withdrawn in line 238. In another aspect, the diesel stream in line 223 is a first stage diesel product stream. In an exemplary embodiment, the first stage diesel product stream in line 238 may range from about 100 wt % to about 0 wt % of the kerosene stream in line 234. In another exemplary embodiment, the first stage diesel product stream in line 238 may range from about 45 wt % to about 5 wt % of the kerosene stream in line 234. In yet another exemplary embodiment, the first stage diesel product stream in line 238 may range from about 35 wt % to about 15 wt % of the kerosene stream in line 234.

An unconverted oil (UCO) stream in line 186 may be withdrawn from the bottoms of the first stage fractionation column 180. In accordance with the present process, unconverted oil stream in line 186 is a first UCO stream obtained from the first stage of the hydrocracking unit 101. The quality of the first UCO stream in line 186 inter alia depends upon the catalyst of the first stage hydrocracking reactor 130 and the conversion rate in the first stage hydrocracking reactor 130. Applicants have found that running the first stage hydrocracking reactor 130 with the distillate selective catalyst and at a conversion rate of from about 50% to about 80% or from about 60% to about 70% provides a high quality first UCO stream in line 186. In an aspect of the present process, the high quality first UCO stream in line 186 may be characterized by a viscosity index (VI) in the range from about 100 to about 150 or from about 105 to about 140. The high quality first UCO stream in line 186 may be used for base oil production. In an embodiment, a UCO yield ranging from about 10 wt % to about 50 wt % of the fresh feed or form about 20 wt % to about 45 wt % of the fresh feed in line 102 may be obtained in the high quality first UCO stream in line 186 in accordance with the current process. A required amount of UCO may be taken from the first UCO stream in line 186 to downstream base oil unit for the production of lube base oils. In an aspect, a portion of the first UCO stream in line 186 may be recycled to the hydrocracking unit 101 in line 188. In an exemplary embodiment, the portion of the first UCO stream in line 188 recycled to the hydrocracking unit 101 may range from about 0 wt % to about 75 wt % of the UCO stream in line 186. In another exemplary embodiment, the portion of the first UCO stream in line 188 recycled to the hydrocracking unit 101 may range from about 20 wt % to about 60 wt % of the UCO stream in line 186. In yet another exemplary embodiment, the portion of the first UCO stream in line 188 recycled to the hydrocracking unit 101 may range from about 30 wt % to about 50 wt % of the UCO stream in line 186. A remaining portion of the first UCO stream may be withdrawn in line 187 and passed to the base oil unit for the production of lube base oils. In an exemplary embodiment, the remaining portion of the first UCO stream in line 187 for producing the base oils may range from about 100 wt % to about 25 wt % of the UCO stream in line 186. In another exemplary embodiment, the remaining portion of the first UCO stream in line 187 for producing the base oils may range from about 80 wt % to about 40 wt % of the UCO stream in line 186. In yet another exemplary embodiment, the remaining portion of the first UCO stream in line 187 for producing the base oils may range from about 70 wt % to about 50 wt % of the UCO stream in line 186.

In accordance with an aspect of the present process, the fractionated overhead stream in line 181 is further processed to provide the naphtha stream. The fractionated overhead stream in line 181 may be condensed and separated in a receiver 190 with a portion of a condensed liquid in line 192 being refluxed back to the first stage fractionation column 180 in a reflux line 194. A net portion of the condensed liquid 192 may be further processed or recovered as naphtha product stream in line 196. In an aspect, the first stage fractionation column 180 may be a totally condensing column that does not produce an off-gas stream.

In an embodiment, the condensed liquid stream in line 196 along with the first stage overhead naphtha stream in line 175 and a second stage overhead naphtha stream in line 317 may be passed to the debutanizer column 240 to recover naphtha product stream. In a non-limiting aspect, any suitable method may be employed to recover naphtha product stream from the condensed liquid in line 196, the first stage overhead naphtha stream in line 175 and the second stage overhead naphtha stream in line 317. In an exemplary embodiment, the condensed liquid in line 196, the first stage overhead naphtha stream in line 175 and the second stage overhead naphtha stream in line 317 may be combined to provide a net overhead stream in line 198. The net overhead stream in line 198 may be passed to the debutanizer column 240 to recover naphtha. The debutanizer column 240 may separate the condensed liquid in line 196, the first stage overhead naphtha stream in line 175 and the second stage overhead naphtha stream in line 317 to provide a debutanizer overhead stream comprising LPG and a debutanized bottoms stream comprising light naphtha. An overhead stream in line 241 from the debutanizer column 240 may be cooled and separated in a receiver 242 to provide an overhead gas stream comprising C2 and lighter gases in a debutanizer off-gas stream in a debutanizer off-gas line 243 and a debutanizer liquid overhead stream comprising LPG in line 244. A portion of the debutanizer liquid overhead stream in line 244 may be recycled to the debutanizer column 240 in a debutanizer reflux line 246. A net debutanizer overhead liquid stream comprising LPG is withdrawn in a net debutanizer overhead liquid stream in line 245. A debutanized boilup stream in debutanized reboil line 249 may be returned to the debutanizer column 240 after reboiling. A net debutanized bottoms stream in line 248 is withdrawn from the debutanizer column 240. The debutanizer column 240 may be operated at a bottoms temperature between about 121° C. (250° F.) and about 177° C. (350° F.) and an overhead pressure between about 690 kPa (100 psi) and about 1379 kPa (200 psi). The net debutanized bottoms stream in line 248 comprises more light naphtha than in the net debutanizer overhead liquid stream comprising LPG in the net debutanizer overhead liquid stream in line 245. The net debutanizer overhead liquid stream comprising LPG in the net debutanizer overhead liquid stream in line 245 may comprise between about 10 mol % and about 30 mol % propane and between about 60 mol % and about 90 mol % butane.

The net debutanized bottoms stream in line 248 may be passed to a naphtha splitter column 250 to separate light naphtha from heavy naphtha. The naphtha splitter column 250 separates the net debutanized bottoms stream in line 248 to provide an overhead stream comprising light naphtha in line 251 and a net bottoms stream comprising heavy naphtha in line 258. The overhead stream comprising light naphtha in line 251 from the naphtha splitter column 250 may be cooled and separated in a receiver 252 to provide an overhead gas stream comprising lighter gases in an off-gas stream in an off-gas line 253 and an overhead liquid stream comprising light naphtha in line 254. In an embodiment, the naphtha splitter column 250 may be a totally condensing column and does not produce the off-gas stream 253. A portion of the overhead liquid stream in line 254 may be recycled back to the naphtha splitter column 250 in a reflux line 256. The light naphtha stream is withdrawn in a net overhead liquid line 255. A boilup stream in a reboil line 259 may be returned to the naphtha splitter column 250 after reboiling. The net bottoms stream in line 258 may passed to a sulfur guard bed 217 to remove sulfur. In an aspect, the heavy naphtha stream in line 214 may be passed to the sulfur guard bed 217 along with the net bottoms stream in line 258 to remove sulfur and provide a desulfurized heavy naphtha stream in line 218. In exemplary embodiment, the heavy naphtha stream in line 214 may be combined with the net bottoms stream in line 258 and passed to the sulfur guard bed 217 in line 216.

Referring back to the first stage fractionation column 180, the portion of the kerosene stream in line 226, the portion of the diesel stream in line 236, and the portion of the first UCO stream in line 188 may be recycled to the hydrocracking unit 101. In an aspect, one, two or all of the portion of the kerosene stream in line 226, the portion of the diesel stream in line 236, and the portion of the first UCO stream in line 188 may be recycled to a second stage hydrocracking reactor 280 of the hydrocracking unit 101 to provide a second unconverted oil stream. In an exemplary embodiment, one, two or all of the portion of the kerosene stream in line 226, the portion of the diesel stream in line 236, and the portion of the first UCO stream in line 188 may be combined to provide a recycle stream in line 239. The recycle stream in line 239 may be recycled to the hydrocracking unit 101. As described hereinafter in detail, a second unconverted oil stream in line 314 may also be recycled to the hydrocracking unit 101 along with the recycle stream in line 239. In an exemplary embodiment, second unconverted oil stream in line 314 may be combined with the recycle stream in line 239 to provide a combined recycle stream in line 264 which may be recycled to the hydrocracking unit 101.

The present process provides a unique scheme that employs both distillate and naphtha selective catalysts in the same hydrocracking unit in an integrated manner in such a way that not only naphtha production can be maximized but also high quality UCO can be produced for base oil production along with distillates. In accordance with applicants' process, the hydrocracking unit 101 may comprise a multistage hydrocracking unit 101 having a first stage hydrocracking reactor 130 and a second stage hydrocracking reactor 280. The applicants' process comprise using a distillate selective catalyst in the first stage hydrocracking reactor 130 and a naphtha selective catalyst in the second stage hydrocracking reactor 280 to maximize naphtha production while producing base oil. The current process may also include more than two hydrocracking reactors with distillate selective catalyst and naphtha selective catalyst. Kerosene and distillate production in lines 226 and 236 from the integrated scheme of the FIG. 1*n* excess of what is required for fuels requirements may be recirculated back to the second stage hydrocracking reactor 280 to maximize naphtha production. The present process comprises recycling the portion of the kerosene stream in line 226, the portion of the diesel stream in line 236, and the portion of the first UCO stream in line 188 to the second stage hydrocracking reactor 280 of the hydrocracking unit 101.

Referring back to the FIGURE, the combined recycle stream in line 264 may be recycled to the second stage hydrocracking reactor 280. The combined recycle stream in line 264 may enter the second stage hydrocracking reactor 280 via a recycle surge drum 265. From the bottoms of the recycle surge drum 265, the combined recycle stream flows in line 266 to the suction of a recycle charge pump 267 to provide a pumped combined recycle stream in line 268. The pumped combined recycle stream in line 268 may be heated up by heat exchange with a second hydrocracked effluent stream in line 282. After the heat exchange, a hydrogen stream in line 338 may be added to the pumped combined recycle stream in line 268 to provide a mixed recycle stream in line 272. The hydrogen stream in line 338 may also be taken from the compressed hydrogen stream in line 332. In an exemplary embodiment, the hydrogen stream in line 338 is a second hydrogen stream. In an aspect, the hydrogen stream in line 338 may join the pumped combined recycle stream in line 268 as the second hydrogen stream to provide the mixed recycle stream in line 272. The mixed recycle stream in line 272 may be heated in a second stage feed heater 274 to provide a heated recycle stream in line 276 that may be fed to the second stage hydrocracking reactor 280.

The second stage hydrocracking reactor 280 may comprise a plurality of second hydrocracking catalyst beds 281. In an aspect, the second hydrocracking catalyst in beds 281 of the second stage hydrocracking reactor 280 may comprise a naphtha selective catalyst to produce a second hydrocracked effluent stream. Suitable second hydrocracking catalyst may comprise one or more of the hydrocracking catalysts as described earlier for the first hydrocracking catalyst. Compared to the distillate selective catalyst of the first stage hydrocracking reactor 130, the naphtha selective catalyst of the second stage hydrocracking reactor 280 may be characterized by a higher activity. The higher activity the naphtha selective catalyst of the second stage hydrocracking reactor 280 may be due to a higher zeolite content and/or a higher metals contents in the naphtha selective catalyst as compared to the distillate selective catalyst. Optionally, a third hydrogen manifold 333*c* may provide a third set of supplemental hydrogen streams to some or all of the catalyst beds 281 at the interbed locations in the second stage hydrocracking reactor 280. In the second stage hydrocracking reactor 280, the combined recycle stream comprising the recycle stream in line 239 and the the second unconverted oil stream in line 314 is hydrocracked in the presence of the naphtha selective catalyst and the second hydrogen stream to produce a second hydrocracked effluent stream in line 282. The second hydrocracked effluent stream in line 282 is withdrawn from the bottoms of the second stage hydrocracking reactor 280. The second hydrocracked effluent stream in line 282 may be passed to the fractionation section 105 for separation after heat exchange with the combined recycle stream in line 268.

In an embodiment, the hydrocracking conditions of the second stage hydrocracking reactor 280 may include a temperature from about 290° C. (550° F.) to about 468° C. (875° F.), or from about 343° C. (650° F.) to about 445° C. (833° F.). In another embodiment, the second stage hydrocracking reactor 280 may operate at a first hydrocracking pressure from about 4.8 MPa (gauge) (700 psig) to about 20.7 MPa (gauge) (3000 psig), a liquid hourly space velocity (LHSV) from about 0.4 $hr^{-1}$ to less than about 5 $hr^{-1}$ and a hydrogen rate of about 421 $Nm^3/m^3$ (2,500 scf/bbl) to about 2,527 $Nm^3/m^3$ oil (15,000 scf/bbl).

The second hydrocracked effluent stream in line 282 may be separated in a hot separator of the fractionation section 105 to provide a vapor hydrocracked stream and a liquid hydrocracked stream. In an aspect, the second hydrocracked effluent stream in line 282 is passed to a second stage hot separator 284 of the fractionation section 105. In the second stage hot separator 284, the second hydrocracked effluent stream in line 282 may be separated to provide the second hot separated vapor hydrocracked stream in line 285 and a second hot separated liquid hydrocracked stream in line 286. The second hot separated vapor hydrocracked stream in line 285 may be withdrawn from the overhead of the second stage hot separator 284. The second hot separated vapor hydrocracked stream in line 285 may be combined with the first hot separated vapor hydrocracked stream in line 142 and passed to the cold separator 145 in the combined hot separated vapor hydrocracked stream in line 144.

The second stage hot separator 284 may operate at a bottoms temperature from about 177° C. (350° F.) to about 371° C. (700° F.) or from about 232° C. (450° F.) to about 315° C. (600° F.). In an aspect, the temperature of the second stage hot separator 284 may be reduced to minimize any UCO in the overhead. The second stage hot separator 284 may be operated at a slightly lower pressure than the second stage hydrocracking reactor 280 accounting for pressure drop through intervening equipment. The second stage hot separator 284 may be operated at an overhead pressure from about 3.4 MPa (gauge) (493 psig) and about 20.4 MPa (gauge) (2959 psig). The second hot separated vapor hydrocracked stream in line 285 from the overhead of the second stage hot separator 284 may have a temperature of the operating temperature of the second stage hot separator 282.

In an aspect, the second hot separated liquid hydrocracked stream in line 286 may be let down in pressure and flashed in a second stage hot flash drum 287 to provide the second hot vapor hydrocracked stream in line 288 and a second hot liquid hydrocracked stream in line 289. The light ends get separated in the second hot vapor hydrocracked stream in line 288 which may be withdrawn from the overhead of the second stage hot flash drum 287. The second hot vapor hydrocracked stream in line 288 may be combined with the first hot vapor hydrocracked stream in 152 and passed to the cold flash drum 160 in the combined hot vapor hydrocracked stream in line 155. The second hot liquid hydrocracked stream in line 289 may be withdrawn from the bottoms of the second stage hot flash drum 287. Accordingly, the second hot liquid hydrocracked stream in line 289 may be provided from the second stage hot separator 284. The second hot flash drum 287 may be in direct, downstream communication with the second hot separated liquid hydrocracked stream in line 286 and in downstream communication with the hydrocracking unit 101. The light gases such as hydrogen sulfide may be stripped from the second hot liquid hydrocracked stream in line 289 in a stripper to provide a liquid hydrocracked stream. In an embodiment, the second hot liquid hydrocracked stream in in line 289 may be fractionated in a second stage fractionation column 310 of the fractionation section 105 to provide the second stage overhead naphtha stream in line 317, a second stage kerosene stream, a second stage diesel stream, and the second unconverted oil stream in line 314. The second stage fractionation column 310 may be in downstream communication with the second stage hot flash drum 287 and the second hot liquid hydrocracked stream in line 289. A stripping media such as low pressure steam in line 297 may be provided to the second stage fractionation column 310 for stripping the light materials from the heated second hot liquid hydrocracked stream in line 296. The steam in line 297 is optionally a low pressure steam and steam at any suitable pressure may be provided to the second stage fractionation column 310.

The second hot flash drum 287 may be operated at the same bottoms temperature as the second hot separator 284 but at a lower overhead pressure of between about 1.4 MPa (gauge) (200 psig) and about 6.9 MPa (gauge) (1000 psig), suitably no more than about 3.8 MPa (gauge) (550 psig). The second hot liquid hydrocracked stream in line 289 may have a temperature of the operating temperature of the second stage hot flash drum 287.

The second hot liquid hydrocracked stream in line 289 may be passed to the stripping column 290. A stripping media such as medium pressure steam in line 291 may be provided to the stripping column 290. The steam in line 291 is optionally a medium pressure steam and steam at any suitable pressure may be provided to the stripping column 290. In the stripping column 290, the second hot liquid hydrocracked stream in line 289 may be stripped to provide the overhead vapor hydrocracked stream in line 292 and a stripped second hot liquid hydrocracked stream in line 294. The overhead vapor hydrocracked stream in line 292 may be passed in line 164 along with the cold liquid stream in line 162 to the cold stripper column 170*a* of the first stage stripper 170. The stripped second hot liquid hydrocracked stream in line 294 may be passed to the second stage fractionation column 310. In an exemplary embodiment, the stripped second hot liquid hydrocracked stream in line 294 may be heated in a feed heater 295 to provide a heated second hot liquid hydrocracked stream in line 296. The heated second hot liquid hydrocracked stream in line 296 may be fractionated in the second stage fractionation column 310. The second stage fractionation column 310 separates the heated second hot liquid hydrocracked stream in line 296 to provide a fractionator overhead stream comprising naphtha in line 312 and a bottoms stream comprising UCO in line 311. Compared to high quality first UCO stream 186 obtained from the first stage of the hydrocracking unit 101, the UCO obtained from the second stage fractionation column 310 may require heavy polynuclear aromatic (HPNA) removal. In an aspect, a UCO drag stream, which may be managed for HPNA removal, may be withdrawn in line 313 from the bottoms stream comprising UCO in line 311. The stripping media in line 297 provided to the second stage fractionation column 310 strips the light material and helps in HPNA removal. In an exemplary embodiment, the UCO drag stream comprising HPNA's in line 313 may range from about 0 wt % to about 5 wt % of the fresh feed stream 102 or from about 0.1 wt % to about 2 wt % of the fresh feed stream 102 or from about 0.2 wt % to about 1 wt % of the fresh feed stream 102. The remaining bottoms stream may be recycled to the hydrocracking unit 101 to maximize overall unit conversion and naphtha production. In another aspect, the remaining bottoms stream is withdrawn as the second unconverted oil stream in line 314 and may be recycled to the second stage hydrocracking reactor 280.

In the second stage fractionation column 310, a second stage diesel stream and/or a second stage kerosene stream may also be separated from the heated second hot liquid hydrocracked stream in line 296. In an exemplary embodiment, the second stage diesel stream and/or the second stage kerosene stream from the second stage fractionation column 310 may be withdrawn in the combined side draw stream in line 319. The combined side draw stream in line 319 may be passed to the first stage fractionation column 180 along with the first liquid hydrocracked stream in line 177, and the heated second liquid hydrocracked stream in line 262.

The fractionator overhead stream comprising naphtha in line 312 may be cooled and separated in a receiver 315 to provide a condensed liquid overhead stream in line 316. A portion of the condensed liquid overhead stream in line 316 may be recycled to the second stage fractionation column 310 in a reflux line 318. A net condensed liquid overhead stream is withdrawn as a second stage overhead naphtha stream in line 317 from the second stage fractionation column 310. The second stage overhead naphtha stream in line 317 may be passed to the debutanizer column 240.

The present process also provides integration of the first and the second stage in a manner to maximize the recovery of desired hydrocarbons and minimizing the equipment in the hydrocracking unit 101. As shown in the FIGURE, the second hot separated vapor hydrocracked stream in line 285 from the second stage hot separator 284 is mixed with first hot separated vapor hydrocracked stream in line 142 from the first stage hot separator 140 to minimize reactor section equipment. Similarly hot flash vapor from both stages i.e. the first hot vapor hydrocracked stream in 152 and the second hot vapor hydrocracked stream in 288 are combined and processed together. Second stage hot flash liquid i.e. the second hot liquid hydrocracked stream in line 289 is then independently stripped of dissolved light components.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect. Further, the FIGURES show one or more exemplary sensors such as 11, 21, 31, 41, and 51 located on one or more conduits. Nevertheless, there may be sensors present on every stream so that the corresponding parameter(s) can be controlled accordingly.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

Specific Embodiments

While the following is described in conjunction with specific embodiments, it will be understood that this description is intended to illustrate and not limit the scope of the preceding description and the appended claims.

A first embodiment of the present disclosure is a hydrocracking process for maximization of naphtha while producing base oil comprising hydrocracking a hydrocarbon feed stream in a hydrocracking unit in the presence of a hydrogen stream and a hydrocracking catalyst to produce a hydrocracked effluent stream; separating the hydrocracked effluent stream in a separator to provide a vapor hydrocracked stream and a liquid hydrocracked stream; fractionating the liquid hydrocracked stream to provide a naphtha stream, a kerosene stream, a diesel stream and a first unconverted oil stream; recycling a recycle stream comprising one, two or all of a portion of the kerosene stream, a portion of the diesel stream, and a portion of the first unconverted oil stream, to the hydrocracking unit to provide a second unconverted oil stream; and withdrawing a remaining portion of the first unconverted oil stream for base oil production. An embodiment of the present disclosure is one, any or all of prior embodiments in this paragraph up through the first embodiment in this paragraph, wherein the separating step further comprises stripping a hot liquid hydrocracked stream and a cold liquid stream to provide the liquid hydrocracked stream. An embodiment of the present disclosure is one, any or all of prior embodiments in this paragraph up through the first embodiment in this paragraph, wherein the hydrocracking unit is a two stage hydrocracking unit comprising a first stage hydrocracking reactor in which the hydrocarbon feed stream is hydrocracked and a second stage hydrocracking reactor to which the recycle stream is recycled. An embodiment of the present disclosure is one, any or all of prior embodiments in this paragraph up through the first embodiment in this paragraph, wherein the separating step further comprises passing the hydrocracked effluent stream to a hot separator to provide a hot separated vapor hydrocracked stream and a hot separated liquid hydrocracked stream; and separating the hot separated liquid hydrocracked stream to provide a hot vapor hydrocracked stream and the hot liquid hydrocracked stream. An embodiment of the present disclosure is one, any or all of prior embodiments in this paragraph up through the first embodiment in this paragraph, wherein separating the hot separated liquid hydrocracked stream comprises passing the hot separated vapor hydrocracked stream to a cold separator to provide a cold separated vapor hydrocracked stream and a cold separated liquid hydrocracked stream; separating the cold separated liquid hydrocracked stream and the hot vapor hydrocracked stream to provide a cold vapor stream and the cold liquid stream; stripping the cold liquid stream and the hot liquid hydrocracked stream to provide the liquid hydrocracked stream; and fractionating the liquid hydrocracked stream to provide the naphtha stream, the kerosene stream, the diesel stream and the first unconverted oil stream. An embodiment of the present disclosure is one, any or all of prior embodiments in this paragraph up through the first embodiment in this paragraph, wherein the stripping step further comprises fractionating the liquid hydrocracked stream in a fractionation column to provide a first side draw stream comprising a naphtha stream, a second side draw stream comprising the kerosene stream and a third side draw stream comprising the diesel stream; and optionally stripping the first side draw stream, the second side draw stream and the third side draw stream to provide a stripped naphtha stream, the kerosene stream and the diesel stream. An embodiment of the present disclosure is one, any or all of prior embodiments in this paragraph up through the first embodiment in this paragraph, wherein the first stage hydrocracking reactor comprises distillate selective catalyst and the second stage hydrocracking reactor comprises naphtha selective catalyst. An embodiment of the present disclosure is one, any or all of prior embodiments in this paragraph up through the first embodiment in this paragraph, further comprising hydrocracking the hydrocarbon feed stream in the first stage hydrocracking reactor in the presence of a first hydrogen stream and a distillate selective catalyst to produce a first hydrocracked effluent stream; passing the first hydrocracked effluent stream to a first stage hot separator to provide a first hot separated vapor hydrocracked stream and a first hot separated liquid hydrocracked stream; passing the first hot separated vapor hydrocracked stream and a second hot separated vapor hydrocracked stream to the cold separator to provide the cold separated vapor hydrocracked stream and the cold separated liquid hydrocracked stream; separating the first hot separated liquid hydrocracked stream in a first stage hot flash drum to provide a first hot vapor hydrocracked stream and a first hot liquid hydrocracked stream; passing the first hot vapor hydrocracked stream, the first cold separated liquid hydrocracked stream, and a second hot vapor hydrocracked stream to the cold flash drum to provide a cold vapor stream and the cold liquid stream; and stripping the cold liquid stream, an overhead vapor hydrocracked stream, and the first hot liquid hydrocracked stream to provide the liquid hydrocracked stream. An embodiment of the present disclosure is one, any or all of prior embodiments in this paragraph up through the first embodiment in this paragraph, wherein the stripping step comprises passing the cold liquid stream and the overhead vapor hydrocracked stream to a first stage stripper, wherein the first stage stripper comprises a cold stripper and a hot stripper; stripping the cold liquid stream and the overhead vapor hydrocracked stream in the cold stripper to provide a first liquid hydrocracked stream and a first stage overhead naphtha stream; and stripping the first hot liquid hydrocracked stream in the hot stripper to provide a second liquid hydrocracked stream; the stripping steps further comprise passing the first liquid hydrocracked stream and the second liquid hydrocracked stream to a first stage fractionation column, wherein the first liquid hydrocracked stream is passed at a location above the second liquid hydrocracked stream into the first stage fractionation column; passing a combined side draw stream to the first stage fractionation column at a location above the second liquid hydrocracked stream and below the first liquid hydrocracked stream in the first stage fractionation column; and fractionating the first liquid hydrocracked stream, the second liquid hydrocracked stream, and the combined side draw stream in the first stage fractionation column to provide the naphtha stream, the kerosene stream, the diesel stream and the first unconverted oil stream. An embodiment of the present disclosure is one, any or all of prior embodiments in this paragraph up through the first embodiment in this paragraph, further comprising hydrocracking the recycle stream and the second unconverted oil stream in the second stage hydrocracking reactor in the presence of the naphtha selective catalyst and a second hydrogen stream to produce a second hydrocracked effluent stream; passing the second hydrocracked effluent stream to a second stage hot separator to provide a second hot separated vapor hydrocracked stream and a second hot separated liquid hydrocracked stream; separating the second hot separated liquid hydrocracked stream in a second stage hot flash drum to provide a second hot vapor hydrocracked stream and a second hot liquid hydrocracked stream; and fractionating the second hot liquid hydrocracked stream in a second stage fractionation column to provide a second stage overhead naphtha stream, a second stage kerosene stream or a second stage diesel stream, and the second unconverted oil stream. An embodiment of the present disclosure is one, any or all of prior embodiments in this paragraph up through the first embodiment in this paragraph, wherein fractionating the second hot liquid hydrocracked stream further comprises combining the second unconverted oil stream with the recycle stream to provide a combined recycle stream; and recycling the combined recycle stream to the second stage hydrocracking reactor An embodiment of the present disclosure is one, any or all of prior embodiments in this paragraph up through the first embodiment in this paragraph, wherein the second stage kerosene stream and the second stage diesel stream are withdrawn as the combined side draw stream from the second stage fractionation column. An embodiment of the present disclosure is one, any or all of prior embodiments in this paragraph up through the first embodiment in this paragraph, wherein fractionating the second hot liquid hydrocracked stream further comprises stripping the second hot liquid hydrocracked stream to provide the overhead vapor hydrocracked stream and a stripped second hot liquid hydrocracked stream; and fractionating the stripped second hot liquid hydrocracked stream in the second stage fractionation column to provide the second stage overhead naphtha stream, the second stage kerosene stream or the second stage diesel stream, and the second unconverted oil stream. An embodiment of the present disclosure is one, any or all of prior embodiments in this paragraph up through the first embodiment in this paragraph, wherein the second unconverted oil stream has a viscosity index of about 100 to about 150. An embodiment of the present disclosure is one, any or all of prior embodiments in this paragraph up through the first embodiment in this paragraph, wherein the portion of the first unconverted oil stream recycled to the hydrocracking reactor ranges from about 0 wt % to about 75 wt % of the first unconverted oil stream. An embodiment of the present disclosure is one, any or all of prior embodiments in this paragraph up through the first embodiment in this paragraph, wherein fractionating the stripped second hot liquid hydrocracked stream further comprises passing the second stage overhead naphtha stream, the first stage overhead naphtha stream and the naphtha stream to a debutanizer column to provide an overhead stream comprising LPG and a bottoms stream comprising naphtha; passing the bottoms stream to a naphtha splitter column to provide an overhead stream comprising light naphtha and a splitter bottoms stream comprising heavy naphtha; and combining the splitter bottoms stream with the stripped naphtha stream to provide a heavy naphtha stream.

A second embodiment of the present disclosure is a hydrocracking process for maximization of naphtha while producing base oil, comprising hydrocracking a hydrocarbon feed stream in a first stage hydrocracking reactor in the presence of a first hydrogen stream and a distillate selective catalyst to produce a first hydrocracked effluent stream; separating the first hydrocracked effluent stream to provide a vapor hydrocracked stream and a liquid hydrocracked stream; fractionating the liquid hydrocracked stream to provide a naphtha stream, a kerosene stream, a diesel stream and a first unconverted oil stream; recycling a portion of the kerosene stream, a portion of the diesel stream, and a portion of the first unconverted oil stream, to a second stage hydrocracking reactor; hydrocracking a second unconverted oil stream and a recycle stream comprising a portion of the kerosene stream, a portion of the diesel stream, and a portion of the first unconverted oil stream in the second stage hydrocracking reactor in the presence of the naphtha selective catalyst and a second hydrogen stream to produce a second hydrocracked effluent stream; separating the second hydrocracked effluent stream to provide the second unconverted oil stream; and withdrawing a remaining portion of the first unconverted oil stream for base oil production. An embodiment of the present disclosure is one, any or all of prior embodiments in this paragraph up through the second embodiment in this paragraph, wherein the first hydrocracked effluent stream is separated in a first stage hot separator and the second hydrocracked effluent stream is separated in a second stage hot separator.

A third embodiment of the present disclosure is a hydrocracking process for maximization of naphtha while producing base oil, comprising hydrocracking a hydrocarbon feed stream in a hydrocracking unit to produce a first hydrocracked effluent stream; passing the first hydrocracked effluent stream to a first stage hot separator to provide a first hot separated vapor hydrocracked stream and a first hot separated liquid hydrocracked stream; passing the first hot separated liquid hydrocracked stream to a first stage hot flash drum to provide a first hot vapor hydrocracked stream and a first hot liquid hydrocracked stream; passing the first hot vapor hydrocracked stream, a second hot vapor hydrocracked stream and a cold separated liquid hydrocracked stream to a cold flash drum to provide a cold liquid stream; fractionating the cold liquid stream and the first hot liquid hydrocracked stream to provide a naphtha stream, a kerosene stream, a diesel stream and a first unconverted oil stream; hydrocracking a second unconverted oil stream and a recycle stream comprising a portion of the kerosene stream, a portion of the diesel stream, and a portion of the first unconverted oil stream in the hydrocracking unit to produce a second hydrocracked effluent stream; passing the second hydrocracked effluent stream to a second stage hot separator to provide the second hot separated vapor hydrocracked stream and a second hot separated liquid hydrocracked stream; passing the second hot separated liquid hydrocracked stream to a second stage hot flash drum to provide the second hot vapor hydrocracked stream and a second hot liquid hydrocracked stream; fractionating the second hot liquid hydrocracked stream to provide the second unconverted oil stream; and withdrawing a remaining portion of the first unconverted oil stream for base oil production.

Without further elaboration, it is believed that using the preceding description that one skilled in the art can utilize the present disclosure to its fullest extent and easily ascertain the essential characteristics of this disclosure, without departing from the spirit and scope thereof, to make various changes and modifications of the present disclosure and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A hydrocracking process for maximization of naphtha while producing base oil comprising:

hydrocracking a hydrocarbon feed stream in a first stage hydrocracking reactor in the presence of a hydrogen stream and a hydrocracking catalyst to produce a first hydrocracked effluent stream;

separating the first hydrocracked effluent stream in a separator to provide a vapor hydrocracked stream and a liquid hydrocracked stream;

fractionating the liquid hydrocracked stream in a first stage fractionation column to provide a naphtha stream, a kerosene stream, a diesel stream and a first unconverted oil stream;

recycling a recycle stream comprising one, two or all of a portion of the kerosene stream, a portion of the diesel stream, and a portion of the first unconverted oil stream to a second stage hydrocracking reactor to provide a second hydrocracked effluent stream;

fractionating the second hydrocracked effluent stream in a second stage fractionation column to provide a second unconverted oil stream;

withdrawing a remaining portion of the first unconverted oil stream for base oil production; and withdrawing a UCO drag stream comprising about 0.1 wt % to about 5 wt % of said hydrocarbon feed stream from said second unconverted oil stream.

2. The process of claim 1, wherein the first stage hydrocracking reactor comprises distillate selective catalyst and the second stage hydrocracking reactor comprises naphtha selective catalyst.

3. The process of claim 2, further comprising:

hydrocracking the hydrocarbon feed stream in the first stage hydrocracking reactor in the presence of a first hydrogen stream and a distillate selective catalyst to produce the first hydrocracked effluent stream;

passing the first hydrocracked effluent stream to a first stage hot separator to provide a first hot separated vapor hydrocracked stream and a first hot separated liquid hydrocracked stream;

passing the first hot separated vapor hydrocracked stream and a second hot separated vapor hydrocracked stream to the cold separator to provide the cold separated vapor hydrocracked stream and the cold separated liquid hydrocracked stream;

separating the first hot separated liquid hydrocracked stream in a first stage hot flash drum to provide a first hot vapor hydrocracked stream and a first hot liquid hydrocracked stream;

passing the first hot vapor hydrocracked stream, the first cold separated liquid hydrocracked stream, and a second hot vapor hydrocracked stream to the cold flash drum to provide a cold vapor stream and the cold liquid stream; and stripping the cold liquid stream, an overhead vapor hydrocracked stream, and the first hot liquid hydrocracked stream to provide the liquid hydrocracked stream.

4. The process of claim 3, wherein the stripping step comprises:

passing the cold liquid stream and the overhead vapor hydrocracked stream to a first stage stripper, wherein the first stage stripper comprises a cold stripper and a hot stripper;

stripping the cold liquid stream and the overhead vapor hydrocracked stream in the cold stripper to provide a first liquid hydrocracked stream and a first stage overhead naphtha stream; and stripping the first hot liquid hydrocracked stream in the hot stripper to provide a second liquid hydrocracked stream.

5. The process of claim 4, wherein the stripping steps further comprise:

passing the first liquid hydrocracked stream and the second liquid hydrocracked stream to the first stage fractionation column, wherein the first liquid hydrocracked stream is passed at a location above the second liquid hydrocracked stream into the first stage fractionation column;

passing a combined side draw stream to the first stage fractionation column at a location above the second liquid hydrocracked stream and below the first liquid hydrocracked stream in the first stage fractionation column; and fractionating the first liquid hydrocracked stream, the second liquid hydrocracked stream, and the combined side draw stream in the first stage fractionation column to provide the naphtha stream, the kerosene stream, the diesel stream and the first unconverted oil stream.

6. The process of claim 2, further comprising:

hydrocracking the recycle stream and the second unconverted oil stream in the second stage hydrocracking reactor in the presence of the naphtha selective catalyst and a second hydrogen stream to produce a second hydrocracked effluent stream;

passing the second hydrocracked effluent stream to a second stage hot separator to provide a second hot separated vapor hydrocracked stream and a second hot separated liquid hydrocracked stream;

separating the second hot separated liquid hydrocracked stream in a second stage hot flash drum to provide a second hot vapor hydrocracked stream and a second hot liquid hydrocracked stream; and fractionating the second hot liquid hydrocracked stream in a second stage fractionation column to provide a second stage overhead naphtha stream, a second stage kerosene stream or a second stage diesel stream, and the second unconverted oil stream.

7. The process of claim 6, wherein fractionating the second hot liquid hydrocracked stream further comprises:

combining the second unconverted oil stream with the recycle stream to provide a combined recycle stream; and recycling the combined recycle stream to the second stage hydrocracking reactor.

8. The process of claim 7, wherein the second stage kerosene stream and the second stage diesel stream are withdrawn as the combined side draw stream from the second stage fractionation column.

9. The process of claim 6, wherein fractionating the second hot liquid hydrocracked stream further comprises:

stripping the second hot liquid hydrocracked stream to provide the overhead vapor hydrocracked stream and a stripped second hot liquid hydrocracked stream; and fractionating the stripped second hot liquid hydrocracked stream in the second stage fractionation column to provide the second stage overhead naphtha stream, the second stage kerosene stream or the second stage diesel stream, and the second unconverted oil stream.

10. The process of claim 1, wherein the second unconverted oil stream has a viscosity index of about 100 to about 150.

11. The process of claim 1, wherein the portion of the first unconverted oil stream recycled to the hydrocracking reactor ranges from about 0 wt % to about 75 wt % of the first unconverted oil stream.

12. The process of claim 9, wherein fractionating the stripped second hot liquid hydrocracked stream further comprises:

passing the second stage overhead naphtha stream, the first stage overhead naphtha stream and the naphtha stream to a debutanizer column to provide an overhead stream comprising LPG and a bottoms stream comprising naphtha;

passing the bottoms stream to a naphtha splitter column to provide an overhead stream comprising light naphtha and a splitter bottoms stream comprising heavy naphtha; and combining the splitter bottoms stream with the stripped naphtha stream to provide a heavy naphtha stream.

13. A hydrocracking process for maximization of naphtha while producing base oil, comprising:

hydrocracking a hydrocarbon feed stream in a first stage hydrocracking reactor in the presence of a first hydrogen stream and a distillate selective catalyst to produce a first hydrocracked effluent stream;

separating the first hydrocracked effluent stream in a first stage fractionation column to provide a vapor hydrocracked stream and a liquid hydrocracked stream;

fractionating the liquid hydrocracked stream to provide a naphtha stream, a kerosene stream, a diesel stream and a first unconverted oil stream;

recycling a portion of the kerosene stream, a portion of the diesel stream, and a portion of the first unconverted oil stream, to a second stage hydrocracking reactor;

hydrocracking a second unconverted oil stream and a recycle stream comprising the portion of the kerosene stream, the portion of the diesel stream, and the portion of the first unconverted oil stream in the second stage hydrocracking reactor in the presence of the naphtha selective catalyst and a second hydrogen stream to produce a second hydrocracked effluent stream;

separating the second hydrocracked effluent stream in a second stage fractionation column to provide the second unconverted oil stream;

withdrawing a remaining portion of the first unconverted oil stream for base oil production; and withdrawing a UCO drag stream comprising about 0.1 wt % to about 2 wt % of said hydrocarbon feed stream from said second unconverted oil stream.

14. A hydrocracking process for maximization of naphtha while producing base oil, comprising:

hydrocracking a hydrocarbon feed stream in a first stage hydrocracking reactor to produce a first hydrocracked effluent stream;

passing the first hydrocracked effluent stream to a first stage hot separator to provide a first hot separated vapor hydrocracked stream and a first hot separated liquid hydrocracked stream;

passing the first hot separated liquid hydrocracked stream to a first stage hot flash drum to provide a first hot vapor hydrocracked stream and a first hot liquid hydrocracked stream;

passing the first hot vapor hydrocracked stream, a second hot vapor hydrocracked stream and a cold separated liquid hydrocracked stream to a cold flash drum to provide a cold liquid stream;

fractionating the cold liquid stream and the first hot liquid hydrocracked stream in a first stage fractionation column to provide a naphtha stream, a kerosene stream, a diesel stream and a first unconverted oil stream;

hydrocracking a second unconverted oil stream and a recycle stream comprising a portion of the kerosene stream, a portion of the diesel stream, and a portion of the first unconverted oil stream in a second stage hydrocracking reactor to produce a second hydrocracked effluent stream;

passing the second hydrocracked effluent stream to a second stage hot separator to provide the second hot separated vapor hydrocracked stream and a second hot separated liquid hydrocracked stream;

passing the second hot separated liquid hydrocracked stream to a second stage hot flash drum to provide the second hot vapor hydrocracked stream and a second hot liquid hydrocracked stream;

fractionating the second hot liquid hydrocracked stream in a second stage fractionation column to provide the second unconverted oil stream;

withdrawing a remaining portion of the first unconverted oil stream for base oil production; and withdrawing a UCO drag stream comprising about 0.1 wt % to about 5 wt % of said hydrocarbon feed stream from said second unconverted oil stream, wherein catalyst in the second stage hydrocracking reactor has higher zeolite content and/or higher metals content as compared to the catalyst in the first stage hydrocracking reactor.

* * * * *